US008695837B2

(12) United States Patent
Sorenson

(10) Patent No.: US 8,695,837 B2
(45) Date of Patent: Apr. 15, 2014

(54) PAINT TRAY ACCESSORY AND ASSEMBLY

(75) Inventor: Gregg R. Sorenson, West Allis, WI (US)

(73) Assignee: Gerhard-Sorenson Corporation, Waukesha, WI (US)

( * ) Notice: Subject to any disclaimer, the term of this patent is extended or adjusted under 35 U.S.C. 154(b) by 788 days.

(21) Appl. No.: 12/792,949

(22) Filed: Jun. 3, 2010

(65) Prior Publication Data

US 2011/0297685 A1 Dec. 8, 2011

(51) Int. Cl.
*B05C 21/00* (2006.01)

(52) U.S. Cl.
USPC .... 220/570; 206/361; 220/495.02; 15/257.05

(58) Field of Classification Search
USPC ..... 206/562, 361, 15.2–15.3; 220/570, 220/495.02, 495.06, 495.01; 15/257.05
See application file for complete search history.

(56) References Cited

U.S. PATENT DOCUMENTS 3,797,049 A * 3/1974 De Santo ..... 62/235
4,356,588 A * 11/1982 Martucci ..... 15/257.06
5,460,289 A 10/1995 Gemmell
5,533,228 A 7/1996 Jarecki et al.
5,553,701 A 9/1996 Jarecki et al.
5,678,277 A 10/1997 Sorenson
5,727,708 A 3/1998 Erickson
6,076,225 A * 6/2000 Sorenson ..... 15/257.06
6,196,410 B1 3/2001 Hocking
6,769,537 B2 * 8/2004 Appelabaum ..... 206/1.5
6,865,769 B1 3/2005 Sorenson
7,484,637 B2 * 2/2009 Cutler et al. ..... 220/570
2005/0098564 A1 * 5/2005 Verbrugge et al. ..... 220/570
2009/0050632 A1 * 2/2009 Martin ..... 220/570

* cited by examiner

*Primary Examiner* — J. Gregory Pickett
*Assistant Examiner* — Robert Poon
(74) *Attorney, Agent, or Firm* — Joseph S. Heino; Patrick M. Bergin

(57) ABSTRACT

A paint tray accessory and assembly provides an impermeable plastic cover and a membrane cover for use with a paint tray and paint roller of conventional manufacture. The membrane cover comprises a first frame member, a second frame member and a fluid regulating membrane. The membrane is flexible and stretchable which provides means for more evenly coating the sleeve of a paint roller during use of the assembly. The membrane also provides a tractive surface for the paint roller sleeve. The frame members are configured to retain the membrane within the frame members and to protect the membrane during use. The first frame member is intended to remain in position while the second frame member is flexibly rotatable relative to the first frame member at the points of certain "breaks" between the two frame members, also considered a "hinged" point.

28 Claims, 14 Drawing Sheets

PAINT TRAY ACCESSORY AND ASSEMBLY

FIELD OF THE INVENTION

The present invention relates generally to devices and methods that are used in the art of surface painting. More particularly, it relates to a paint tray accessory and assembly for use with manual-type paint applicators, especially paint rollers.

BACKGROUND OF THE INVENTION

Paint has long been applied as a surface coating, used primarily for protective and decorative purposes. Paint typically starts out as a liquid composition that comprises different pigments, binders and solvents. Paint can be applied to a surface manually by a user, or a "painter," using a roller, a brush, or any number of other specialized paint-applying devices, rollers being the preferred device for applying paint to relatively large surface areas. Once applied to a surface, the paint solvent evaporates or disintegrates, leaving the pigment and binder to dry to a solid film.

In a liquid state, all paint displays a quality known as "viscosity." Viscosity is described as the thickness of the paint and is a quality that is attributable to the nature of the solvent used. Generally speaking, the higher the viscosity, the thicker the paint is. Viscosity is a property in both alkyd and latex paints that resists flow and movement by force. The solvent used in the paint composition adjusts the paint's viscosity, such as mineral spirits in alkyds and water in latex paint. Paint is also known to be a "shear thinning" fluid. That is, it displays decreasing viscosity with increasing shear rate. Accordingly, and during application to a surface, the shear created by a paint brush or paint roller allows the paint to thin and wet out the surface evenly. Once applied, paints typically regain their higher viscosity which assists in the avoidance of drips and runs.

As alluded to above, it is well known in the art of surface painting that large surface areas can be painted using a paint roller. This is particularly true when applying paint to the interior surfaces of a dwelling, such as walls and ceilings. The typical paint roller comprises an absorbent sleeve portion, a sleeve support frame and a handle. The sleeve portion is usually a cylindrical core having a covering, such as a pile fabric or foam rubber, and is removable from the sleeve support frame. In view of the unique configuration of the typical paint roller, paint pans or trays have also been devised as complementary paint reservoirs to allow for the absorbent sleeve of the paint roller to be "loaded" with paint prior to application.

One of the problems with paint pans or trays of current manufacture, however, is that they are capable of holding only about one quart of paint. They are also prone to paint splashes and spills. In the experience of this inventor, such paint trays also have a tendency to load the paint roller unevenly and are very tedious to work with. One of the reasons for this is that such paint trays require the painter to "even out" the paint on the roller by running it back and forth along the ramped portion of the tray before applying it to the wall (or other like surface).

Paint trays of current manufacture also tend to load the roller with paint heavier on along one side of the cylindrically-shaped roller sleeve, thereby causing uneven application and causing the painter to work the paint out on the wall. In other words, the common paint tray does not allow for an even application of paint to the roller without considerable effort and technique on the part of the painter. In the experience of this inventor, a significant amount of the time involved in the painting process is spent "loading" the roller with paint and then working out an even coating of paint on the wall, a substantial reason for seeking an improvement in the existing art.

Other shortcomings of such paint trays include the fact that they are subject to the collection of foreign debris, such as old plaster, paint, insects, etc., within the tray. This type of debris ultimately shows up on the wall while painting, thereby causing the painter to stop and take the time to remove them, which also disturbs the coating of paint that has been applied to the wall. The common paint tray simply does not filter out any foreign debris, including debris that might reside within a can of old paint that is poured into the tray.

Paint trays of current manufacture also allow the paint to "skin up," or dry during the painting process, thereby causing the paint to thicken or leave lumps of paint remaining on the wall. They also allow the paint to dry and "cake up" on the sides of the tray, thereby making cleanup very difficult. The practical result of this is that the paint tray cannot be left full for any extended period of time without drying and becoming hard to work with. Another shortcoming of paint trays of current manufacture is that they do not allow for any place to rest or support a brush, roller, or other paint applicator when not in use other than within the pool of paint, thereby causing the applicator to become paint-soaked and sloppy.

The foregoing general paint tray arrangement is still widely used today but has been modified in recent years. For example, one configuration and construction that was devised by this inventor is disclosed in U.S. Pat. No. 6,076,225 and entitled "Paint Edger With Improved Pad And Precision Positioning Adjustment." While the paint tray made in accordance with that concept is an improvement over the prior art, the paint tray configuration of the present invention is a substantial further improvement in that same art.

For example, the paint tray accessory and assembly of the present invention will allow a common paint tray to hold up to a gallon of paint, which is four times as much as most common trays. The device of the present invention resists splashing, slopping and spilling. It precisely loads the roller with just the right amount of paint for a smooth and even application. One key concept is that the present assembly loads the roller heavier in the center of the roller and gradually lighter towards its outside edges, thus eliminating the usual thick ridges of paint and paint build-up on the wall. It also loads the roller evenly with quick strokes across the paint tray accessory and is immediately ready for application of the paint to a wall. In this fashion, the device of the present invention transfers a smooth, even coat of paint with just one or two passes across the accessory, thereby substantially reducing painting time. In the experience of this inventor, less time is spent loading the roller and no time is wasted working out the paint on the wall. In short, the device of the present invention allows rollers, brushes and pads to be loaded quickly and evenly with no excess paint to be removed from them.

The device of the present invention utilizes a fluid regulating membrane that is disposed within an accessory element that keeps the paint in the paint tray from drying up while it is being used which results in a consistent paint job from start to finish. This element keeps the paint wet, thereby making cleanup very fast and easy. It also allows for any applicator to be set down atop the membrane without the applicator becoming soaked and sloppy.

Additionally, no time is wasted picking off foreign debris because the device of the present invention allows the painter to see and remove the debris before it gets into the paint or gets on the wall. The accessory also filters out any foreign debris in the paint itself, such as scum, hardened paint chips, and the like, leaving such debris at the bottom of the tray and such debris to be discarded after the paint job is finished.

The assembly of the present invention also includes a clear cover that allows for use of the assembly with a standard paint roller, a paint pad, a brush or just about any other type of manual paint applicator to be stored and kept usable for several days, and even up to a couple of weeks if necessary. It is also desirable that the improved assembly be used as an item that can be made available alternatively as either an originally-manufactured product or as an after-market product.

SUMMARY OF THE INVENTION

The paint tray accessory and assembly of the present invention provides an impermeable plastic cover and a fluid regulating, flexible membrane cover for use with a paint tray of conventional manufacture. The membrane cover comprises a first frame member, a second frame member and a stretchable open cell membrane that is suspended between the frame members. The assembly is intended to be used with a paint roller, or other paint applicator, of conventional manufacture. The first frame member is intended to remain in position while the second frame member is flexibly rotatable relative to the first frame member at the points of certain "breaks" between the two frame members, also considered "hinge" points. To allow the second frame member to be grasped by a user, flanges may be disposed at the corners of the second frame member. The rotatability of the second frame member allows the user to access the paint tray reservoir for re-filling of the reservoir with paint. The second frame member is rotatable upwardly and is configured to remain in an upright position during the re-filling of the reservoir. The impermeable plastic cover and flexible membrane cover are further configured to facilitate bulk nesting of those elements, thus compacting them for packaging and shipment.

The foregoing and other features of the paint tray accessory and assembly of the present invention will be apparent from the following detailed description when read in conjunction with the accompanying drawings.

DETAILED DESCRIPTION

Figure 1:
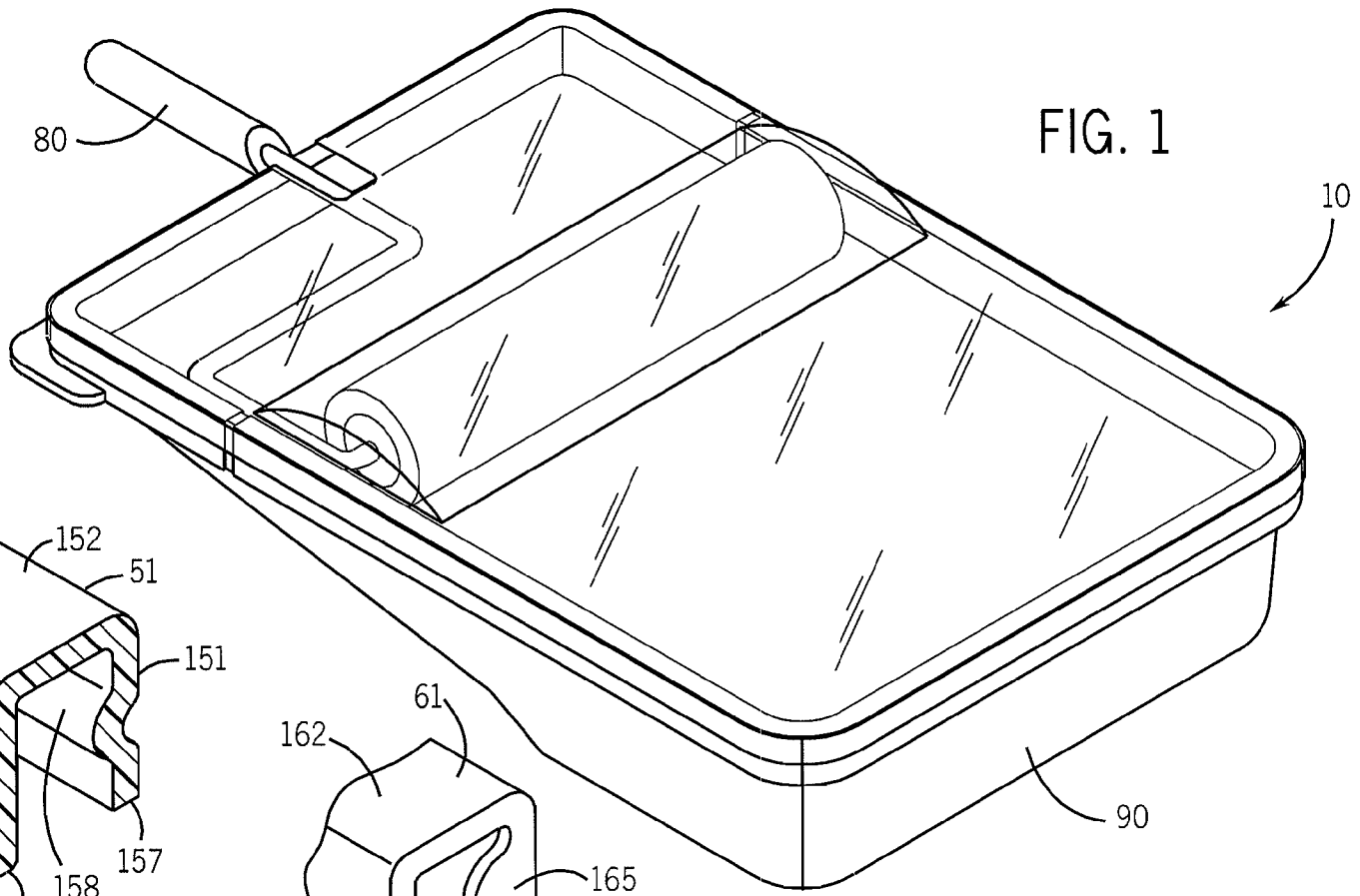
FIG. 1 is a top, rear and right side perspective view of a paint tray assembly of the present invention.
Figure 2B:
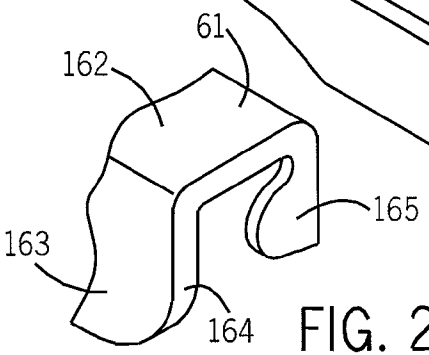
FIG. 2B is a view similar to that shown in FIG. 2A but illustrating a portion of only one element of the membrane cover and showing the detail of the protective lip and the anti-roll projection of a preferred embodiment.
Figure 2A:
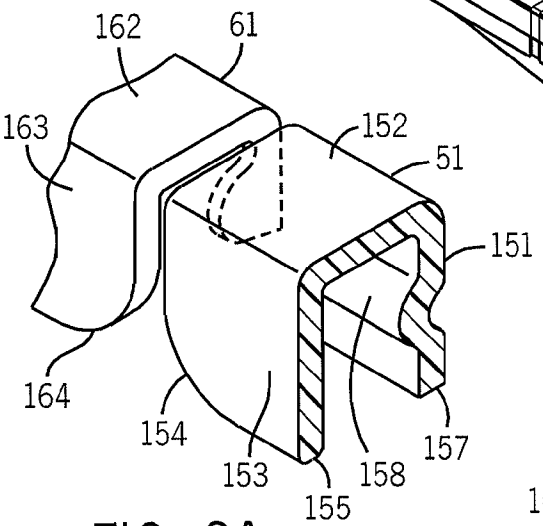
FIG. 2A is a greatly enlarged view of a portion of two elements of the membrane cover of the paint tray assembly and taken along line 2A-2A of FIG. 2.
Figure 2:
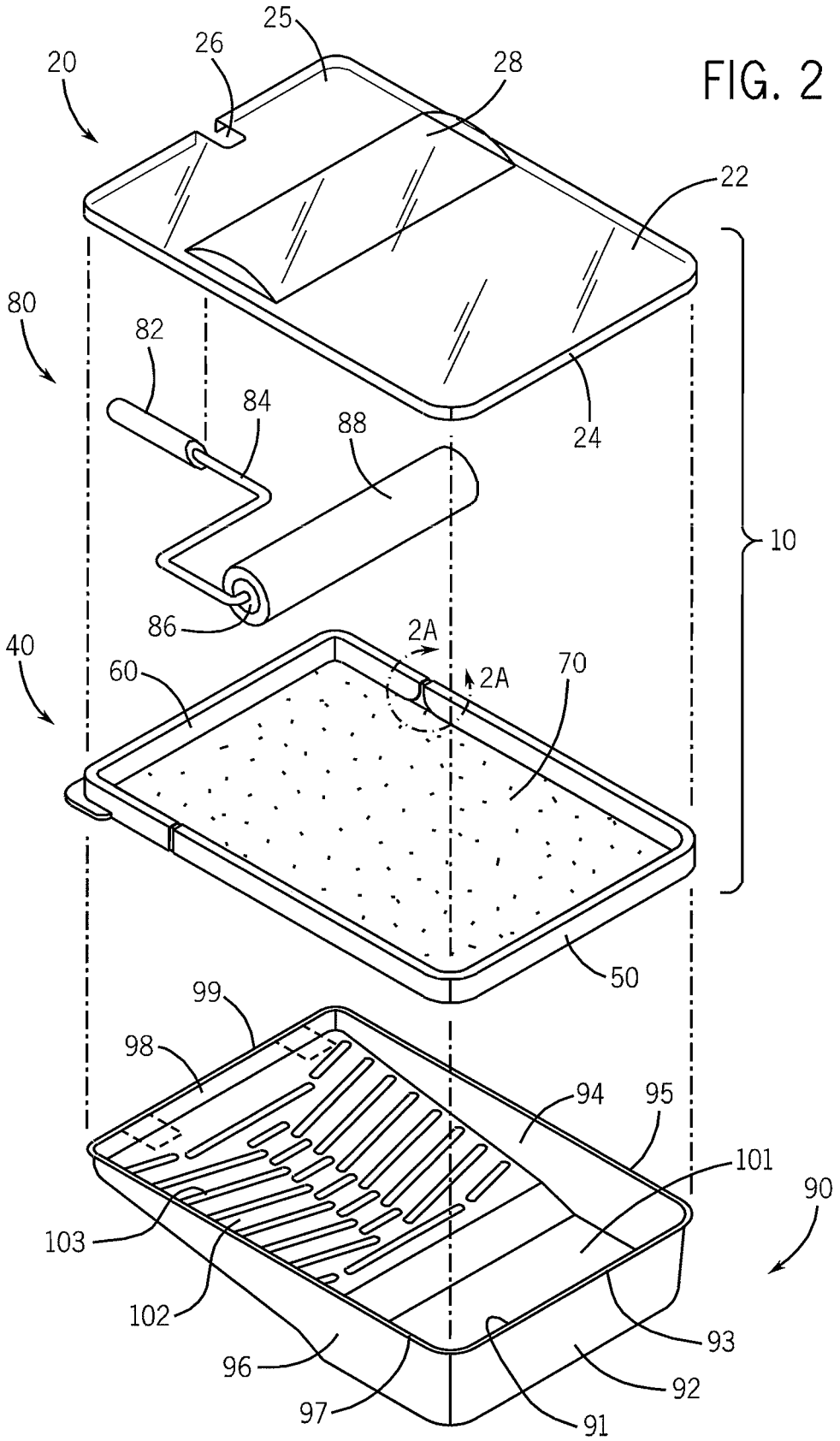
FIG. 2 is an exploded perspective view of the paint tray assembly shown in FIG. 1.

Referring now to the drawings in detail, wherein like-numbered elements refer to like elements throughout, FIGS. 1 and 2 illustrate one assembly that is constructed in accordance with the preferred embodiment of the invention, the assembly being designated generally by the numeral 10. FIG. 1 shows the assembly 10 as fully engaged with a paint tray 90 of conventional manufacture. FIG. 2 shows the assembly 10 and the paint tray 90 in an expanded and un-assembled fashion.

As shown in FIG. 2, it will be seen that the assembly 10 comprises an impermeable plastic cover, generally designated 20, and a fluid regulating, flexible membrane cover, generally designated 40. The membrane cover 40 comprises a first frame member, generally designated 50, a second frame member, generally designated 60, and a flexible and stretchable membrane, generally designated 70. The membrane 70 is made of a fluid regulating, open cell flexible and stretchable foam or other flexible and stretchable fluid regulating material. It is within the scope of the present invention to utilize other fluid regulating membrane materials of the type that provide an even transfer of liquid to the applicator. These would include a flexible screen of woven or nonwoven material. An injection molded plastic matrix that is resilient and perforated could also be used as well as a perforated or a slit-and-expanded paper matrix of a resilient nature that is suitably resistant to paint and moisture. It is also within the scope of the present invention to utilize fluid regulating membrane materials of the type that provide an increased transfer of liquid to the applicator when the membrane 70 is in a relaxed, or un-stretched, state and a decreased transfer of liquid when the membrane 70 is in a stretched state. This functionality will be discussed in greater detail later in this detailed description.

The assembly 10 is intended to be used with the paint tray 90 and a paint roller 80, also of conventional manufacture. For purposes of this detailed description, it will be seen that the paint roller 80 of conventional manufacture comprises a handle 82, a shank portion 84 extending from the handle 82, an absorbent sleeve portion 88, and a sleeve support portion 86 extending from the shank portion 84, the shank portion 84 and the sleeve support portion 86 being fabricated such that the sleeve support portion 86 can rotate about one end of the shank portion 84.

The paint tray 90 is an all-purpose paint receptacle and a unitary structure that includes a main tray portion having substantially vertical front, side, and back wall portions designated 92, 94, 96, 98, respectively. These wall portions 92, 94, 96, 98 have upper margins 93, 95, 97, 99, respectively, which collectively define an access opening, generally designated 91. A bottom floor portion 101 further includes a sloped or ramped portion 102, this sloped or ramped portion 102 being provided with a plurality of detents 103 for assisting the painter in the removal of excess paint (not shown) from the absorbent sleeve 88 of the roller 80.

In such conventional trays 90, the paint-holding capacity of the tray is limited, as a practical matter, by the need to provide such a "rollout" or preparation surface 102, 103, as is described above, to prevent uneven over-impregnation of the absorbent sleeve 88 of the roller 80 with liquid paint. According to the present invention, advantage can be taken of the increased volumetric capacity of the paint tray 90 to minimize the need for repeated filling of the tray 90 with only a small amount of paint, as will be apparent later in this detailed description.

Referring again to FIG. 2, it will be seen that the impermeable plastic cover 20, which can be fabricated of a transparent plastic material as a "blister cover" or the like, comprises a top portion 22. The cover 20 also includes a flexible bottom flange 24, the bottom flange 24 circumferentially surrounding and extending downwardly from the top portion 22 of the plastic cover 20. The flange 24 of the cover 20 is functionally adapted to seal the access opening 91 of the paint tray 90 along the upper margins 93, 95, 97, 99 thereof with the membrane cover 40 being interposed between the cover 20 and the tray 90. Another important feature of the cover 20 of the present invention is a presence of a small opening 26 that is formed in one end 25 of the cover 20. This opening 26 allows the shank portion 84 of the roller 80 to project through it, which substantially closes off the remainder of the opening 26. The cover 20 also includes an arcuate dome 28 that is formed in and extends upwardly from the top portion 22 of the cover 20. This dome 28 is integrally-formed with the other portions of the cover 20 and allows the absorbent sleeve portion 88 of the roller 80 to be disposed below the cover 20 without deforming the cover 20 or causing the cover 20 to lift up and detach itself from the tray 90 when the roller 80 is stowed within the combined tray 90 and assembly 10. See FIG. 1.

Figure 3:
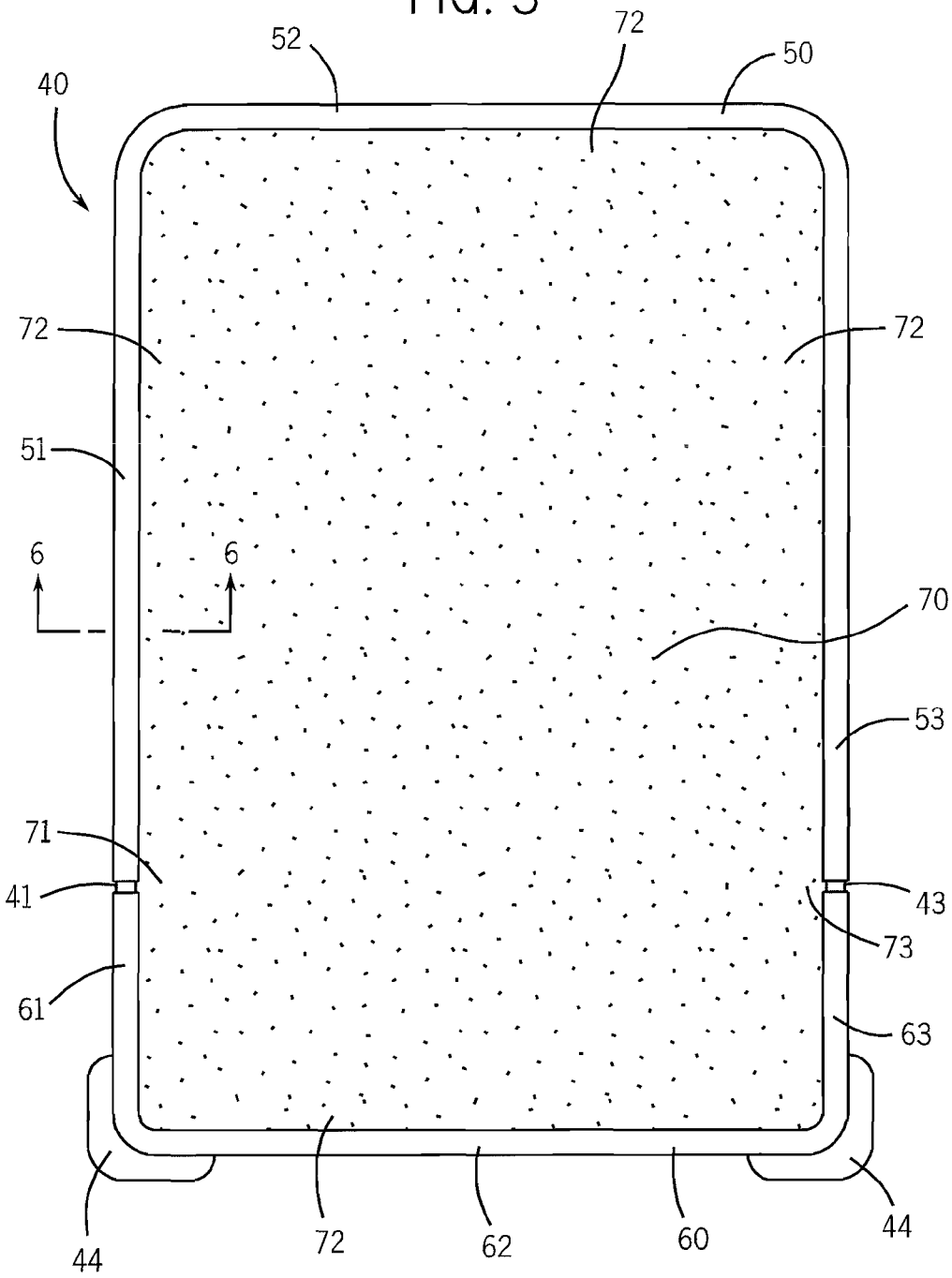
FIG. 3 is a top plan view of the membrane cover of the paint tray assembly of the present invention.

Referring now to FIG. 3, it will be seen that the membrane cover includes a substantially U-shaped first frame member 50 and a substantially U-shaped second frame member 60, the frame members 50, 60 being generally complementary to one another to form a framework for the membrane 70 that is suspended between them. As shown, the first frame member 50 includes a first longitudinally-extending leg 51, a second longitudinally-extending leg 52 and a third longitudinally-extending leg 53. The second leg 52 is transversely disposed relative to the other two legs 51, 53 and the legs 51, 52, 53 of the first frame member 50 are continuous and integrally-formed in the preferred embodiment. Similarly, the second frame member 60 includes a first longitudinally-extending leg 61, a second longitudinally-extending leg 62 and a third longitudinally-extending leg 63. The second leg 62 is transversely disposed relative to the other two legs 61, 63 and the legs 61, 62, 63 of the second frame member 60 are continuous and integrally-formed as well. Preferably, the frame members 50, 60 are formed of a molded or extruded plastic material.

As shown in FIG. 3, it will be seen that the first and second frame members 50, 60 are discontinuous relative to one another. That is, a first break 41 is disposed between the first leg 51 of the first frame member 50 and the first leg 61 of the second frame member 60. A second break 43 is disposed between the third leg 53 of the first frame member 50 and the third leg 63 of the second frame member 60. In this configuration, the first frame member 50 is intended to remain in position while the second frame member 60 is rotatable relative to the first frame member 50 at the points of the breaks 41, 42. See FIG. 7. This particular structure provides for a "hinged" relationship between the frame members 50, 60. See FIG. 8. Alternative embodiments, for example, would allow for the use of a "live" hinge 243 as is shown in FIG. 8A or even a one-piece conventional hinge 343 as is shown in FIG. 8B. It is to be understood that all such hinge means are within the scope of the present invention. To allow the second frame member 60 to be grasped by a user, flanges 44 are disposed at the corners formed by the legs 61, 62, 63 of the second frame member 60.

Figure 4:
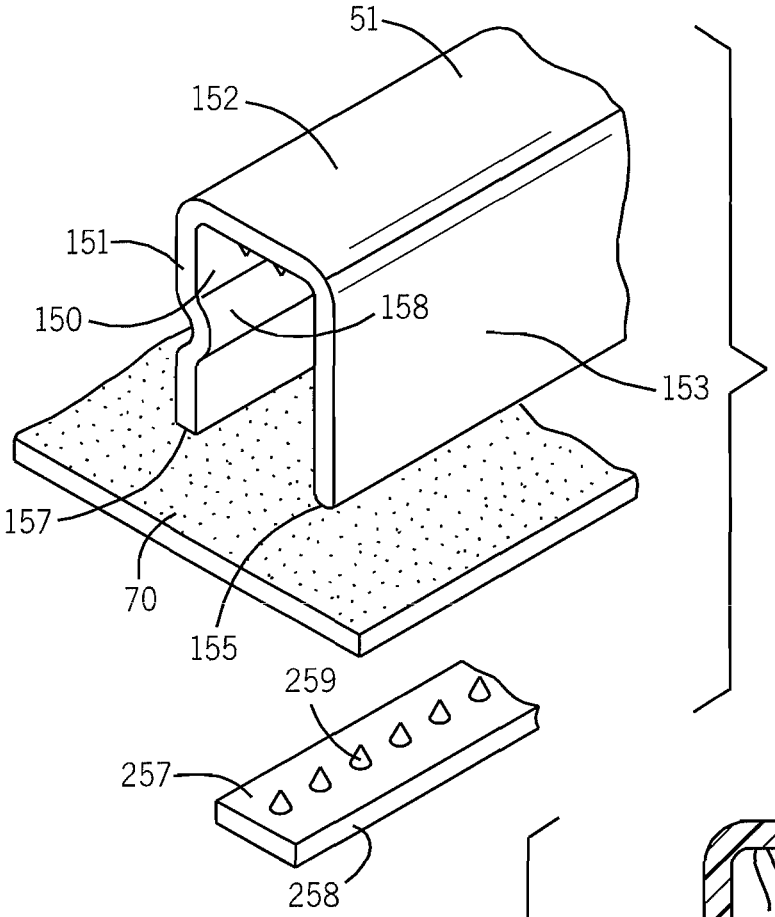
FIG. 4 is an enlarged perspective view of the attachment structure of the membrane cover of the paint tray assembly of the present invention.
Figure 5:
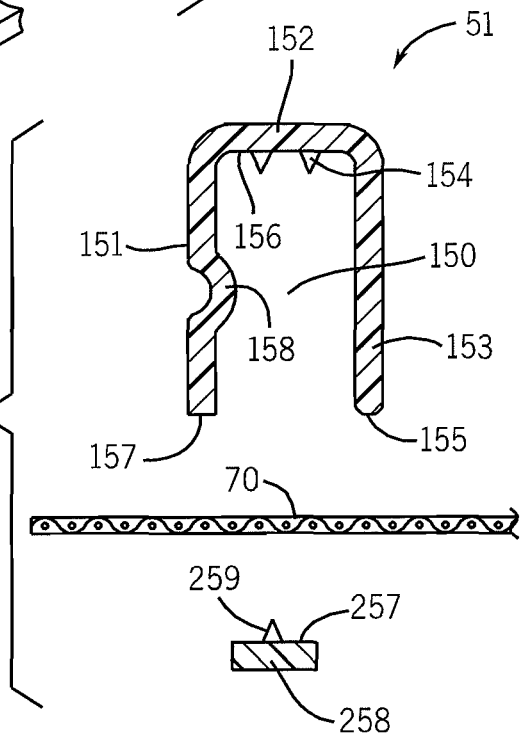
FIG. 5 is an enlarged front and sectioned view of the structure illustrated in FIG. 4 and showing the elements of the pre-assembled attachment structure.
Figure 6:
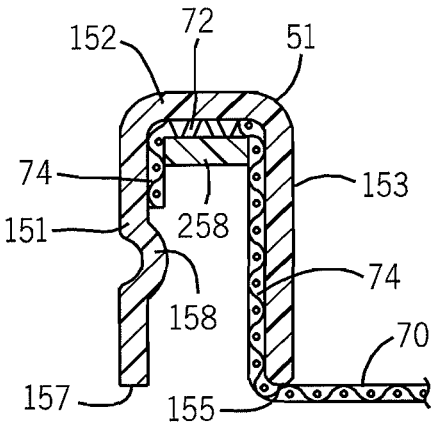
FIG. 6 is the same view of FIG. 5 and showing the elements as assembled.

Referring now to FIGS. 4-6, it will be seen that each leg 51, 52, 53, 61, 62, 63 of the first and second frame members 50, 60, respectively, is actually formed in an inverted U-shape itself. In this configuration, each leg 51, 52, 53, 61, 62, 63 is capable of grasping an upper margin 93, 95, 97, 99 of the paint tray 90. To accomplish this, each leg 51, 52, 53, 61, 62, 63 includes means for grasping onto a portion of the membrane 70 which is positioned between the legs 51, 52, 53, 61, 62, 63 and an upper margin 93, 95, 97, 99. FIG. 5 illustrates, for example, a representative portion of the first leg 51 of the first frame member 50. It is to be understood that the same construction shown is incorporated within each of the other legs 51, 52, 53, 61, 62, 63 of each of the frame members 50, 60, respectively.

Specifically, the leg 51 comprises an integrally-formed and inverted U-shaped structure having a channel 150 that is formed by a first vertical portion 151, a horizontal portion 152 and a second vertical portion 153. The horizontal portion 152 connects the vertical portions 151, 153 together. The first vertical portion 151 can be formed to be longer than the second vertical portion 152, but need not be. See FIGS. 5 and 6. The first vertical portion 151 further comprises a detent 158 to better secure the leg 51 to the pain tray margin 95, for example. This configuration also provides protection to the underlying membrane 70 against abrasion or wear from the roller frame 84 or the roller sleeve 88 during use of the assembly 10. Additionally, the bottommost portion 155 of the second vertical portion 153 is rounded to prevent puncturing or tearing of the flexible membrane 70 during use. In this configuration, the second vertical portion 153, and like structure elsewhere in the assembly 10, becomes a "protective lip." That is, the protective lip 153 protects that portion of the membrane 70 that comes in contact with it. The same is true of the protective lip 133 shown in FIG. 15, for example. The bottom 157 of the other vertical portion 151 does not need to be rounded as it has no direct contact with the membrane 70. Again, the above-mentioned configurations are common to the other legs 52, 53, 61, 62, 63 of the frame members 50, 60, respectively.

In a first preferred embodiment, the horizontal portion 152 further includes retention means in the form of a plurality of projections 154 that extend downwardly from the bottom surface 156 of the horizontal portion 152. Complementary to the structure of the first leg 51 is a fastening member 258 having a top surface 257 and a plurality of projections 259 that extend upwardly from that top surface 257. Referring to FIG. 6, it will be seen that a portion of the peripheral edge 72 of the membrane 70 is trapped between the horizontal portion 152 of the leg 51 and the fastening member 258, and permanently so by means of a suitable means such as heat or sonic welding or the like where the leg 51 and the fastening member 258 are made of plastic. Other fastening means are also within the scope of the present invention. A unique feature of this structure is that the extra margin 74 inside the leg 51 actually assists in the stretching of the membrane 70 within this area during use of the assembly 10, as will be apparent later in this detailed description, the extra margin 74 providing a "reserve" of foam under the protective lip 153.

Figure 12:
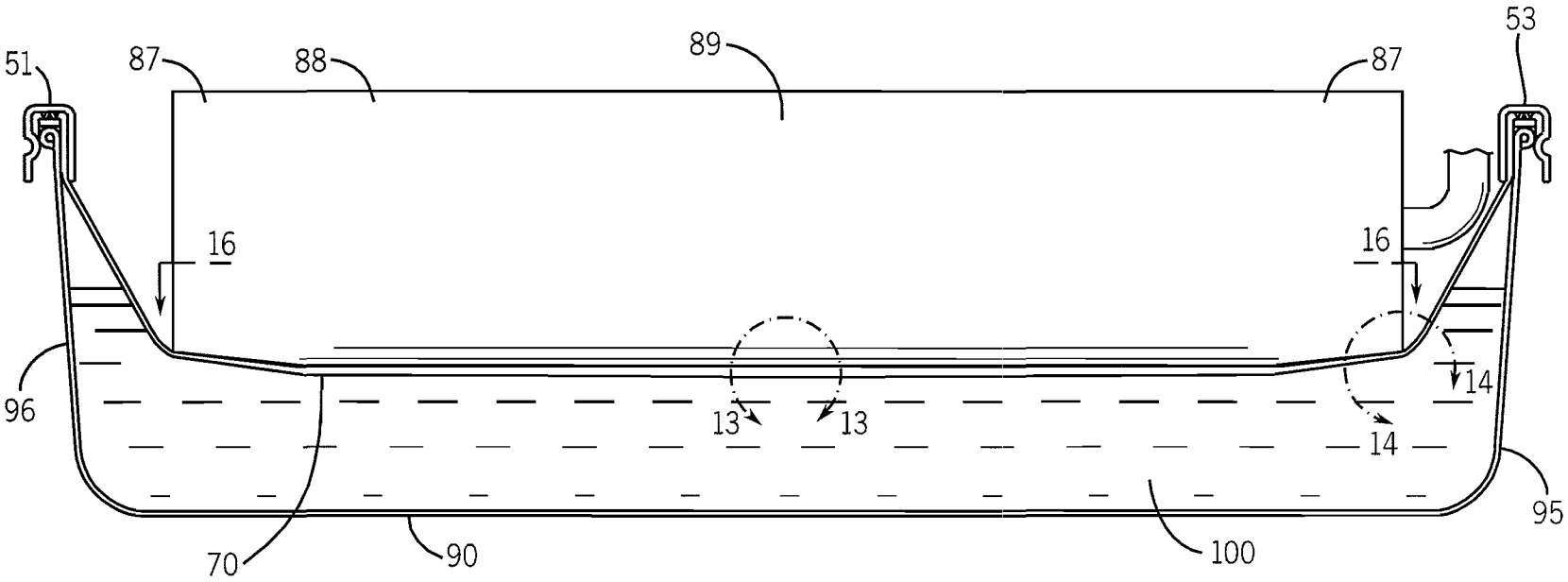
FIG. 12 is an enlarged rear elevational view taken along line 12-12 of FIG. 11.
Figure 15:
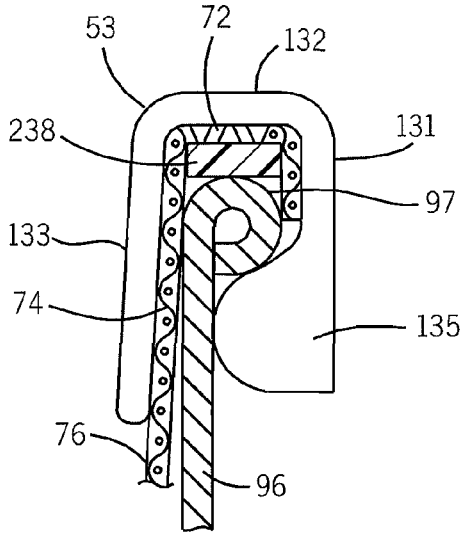
FIG. 15 is another enlarged view taken along line 15-15 of FIG. 9 and showing the membrane being stretched at the edge of the membrane cover.

Another feature that is incorporated into each of the legs 51, 53, 61, 63 of the frame members 50, 60, for purposes of stabilization, is a plurality of inwardly-directed projections. One such projection is disposed in the distal ends of each of the legs 53, 63, respectively. The distal ends of each of the legs 53, 63 are those that are disposed to either side of the break 43. FIG. 2B more clearly shows the detail of the projection 165 used in the leg 61. FIG. 15 also shows a similar projection 135 in engagement with the upper margin 97 of the side wall portion 96 of the tray 90. The projections 135, 165 are "anti-roll" structures. That is, the projections 135, 165 are provided to counter the tendency of the legs 53, 61 to "roll" under the tension of the membrane 70 that is suspended between it and the other legs of the membrane cover 40. In the case of the projection 135, for example, the presence of the projection 135, essentially "pulls" the first vertical portion 133 of the leg 53 inwardly towards the wall 96, in opposition to the pulling force exerted on the second vertical portion 131 of that leg 53 by the membrane 70. Also, the presence of an extra membrane margin 74 inside the leg 51 of the frame member 50 actually assists in the stretching of the membrane 70 within this area during use of the assembly 10, as will be apparent later in this detailed description. This is especially true when a paint roller sleeve portion 88 is pressed into the membrane 70. See, for example, FIG. 12. It is to be understood that the same projections (not shown) are used with the other legs 51, 63 that are disposed along the edges of the tray 90. It is also to be understood that other opposing projections of other means are within the scope of the present invention.

As alluded to previously, a significant feature of the membrane cover 40 in the assembly 10 of the present invention is the use of added means for preventing damage to the membrane 70 during use. Referring to FIGS. 2 and 2A in particular, it will be seen that the distal ends of each of the legs 51, 61 to either side of the break 41 (seen in FIG. 3) includes the rounded bottom 155 at the vertical portion 153. The bottom 157 of the other vertical portion 151 does not need to be rounded as it has no direct contact with the membrane 70. See also FIG. 6. Referring specifically to FIG. 2A, it will also be seen that the vertical portion 153 comprises a curved edge 154. Similarly, the opposing vertical portion 161 comprises a curved edge 164 as well. Both curved edges 154, 164 likewise prevent the membrane 70 from damage during use, especially when the second frame member 60 of the membrane cover 40 is rotated upwardly from the pan 90 which results in a stretching of the membrane 70 at the point of the edges 154, 164.

Figure 17:
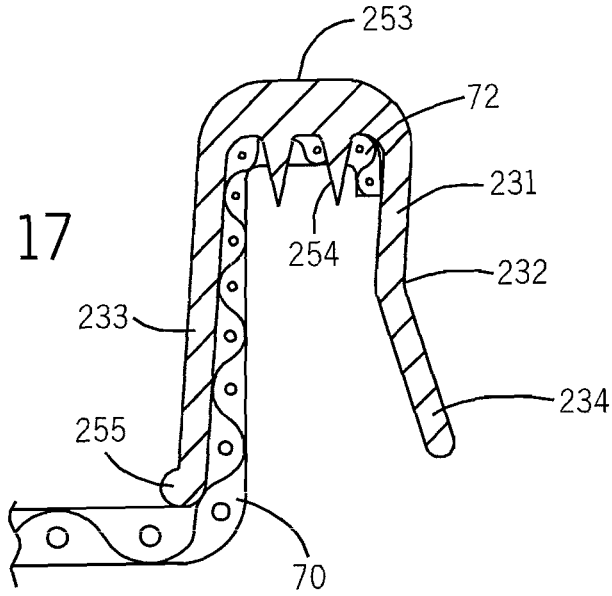
FIG. 17 is a sectioned view similar to that shown in FIG. 6 and illustrating an alternative embodiment wherein the membrane is penetrated by projections disposed within the frame member.
Figure 18:
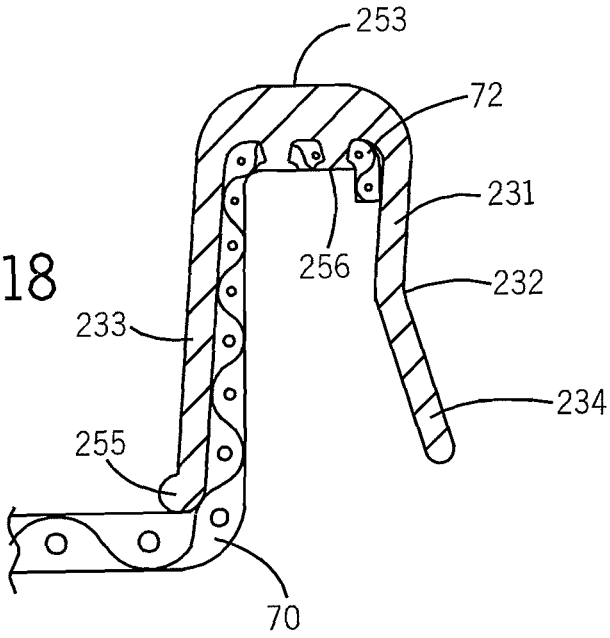
FIG. 18 is the same view as FIG. 17 but showing the membrane after the ends of the projections are melted down and a portion of the membrane is captured by the melted down ends of the projections.

Referring now to FIGS. 17 and 18, which are views similar to FIG. 6 but taken on the opposite side of the frame, they show an alternative embodiment for the frame member profile and membrane securement means. Specifically, the leg 253 is shown fabricated as an inverted U-shaped structure having an outer vertical portion 231 and an inner vertical portion 233. The bottom-most portion 255 of the inner vertical portion 233 comprises a protective lip structure as previously discussed. The outer vertical portion 231 comprises a bent portion 232 and a downward portion 234 which together grasp the edge of the paint tray (not shown) as previously described. Disposed between the vertical portions 231, 233 are a plurality of downwardly extending projections 254. The projections 254 are intended to penetrate the peripheral edge 72 of the membrane 70. During fabrication, the tips 256 of the projections 254 are melted down, flattened and expanded, to effectively entrap the membrane 70 at its peripheral edge 72.

Figure 7:
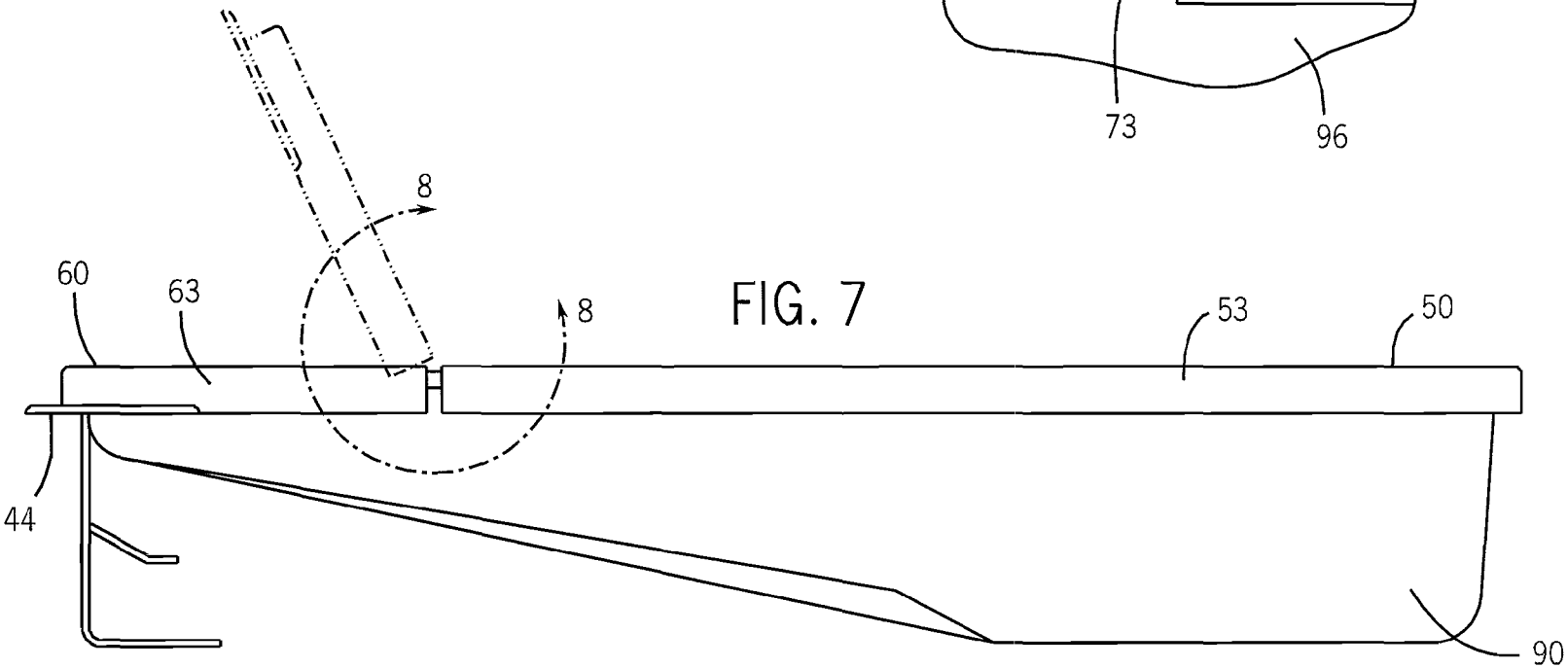
FIG. 7 is a right side elevational view of the membrane cover of the paint tray assembly as attached to a conventional paint tray.

In application, the user of the assembly 10 of the present invention would attach the membrane cover 40 to the paint tray 90 once the tray 90 is filled with liquid paint 100 or, alternatively, prior to filling the tray 90. Where paint 100 is to be added after the membrane cover 40 is secured to the tray 90, or where paint 100 is to be added to refill the tray 90, the second frame member 60 would be lifted as is shown in FIG. 7. The user would then fill the paint tray 90 with liquid paint 100 to a suitable level within the tray 90. In the experience of this inventor, a full gallon of paint 100 can be retained within a common paint tray 90 in accordance with the present invention. Doing so without the use of the assembly 10 of the present invention would create an over-fill situation where excess paint 100 would not be properly removable from the absorbent sleeve 88 of the roller 80. This would be due to the fact that the rollout surfaces 102, 103 of the tray 90 would be situated well below the level of the paint 100 that is contained within the tray 90. In the preferred application, the presence of extra paint 100 within the tray 90 has no effect on the proper and efficient usage of the assembly 10 of the present invention.

Figure 8:
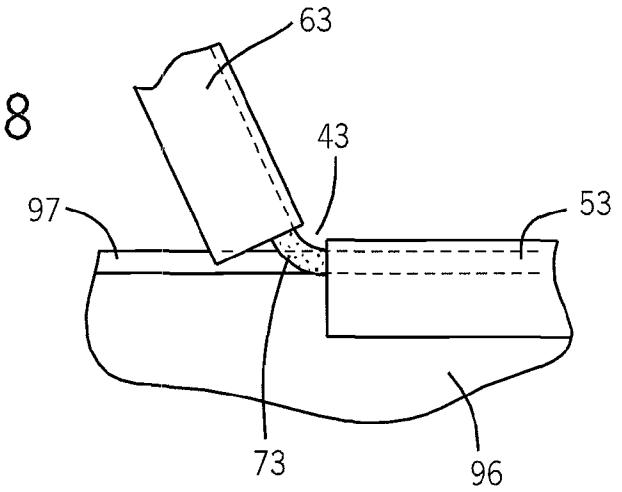
FIG. 8 is an enlarged right side elevational view taken along line 8-8 of FIG. 7 and showing a first embodiment of a hinge used in the membrane cover.
Figure 8A:
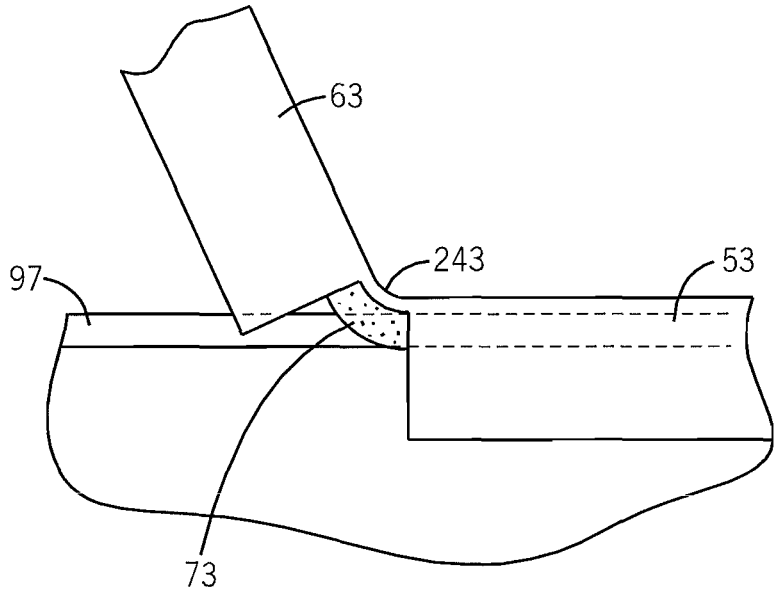
FIG. 8A is a further enlarged right side elevational view taken along line 8-8 of FIG. 7 and showing an alternative embodiment of a hinge, a "live" hinge, used in the membrane cover.
Figure 8B:
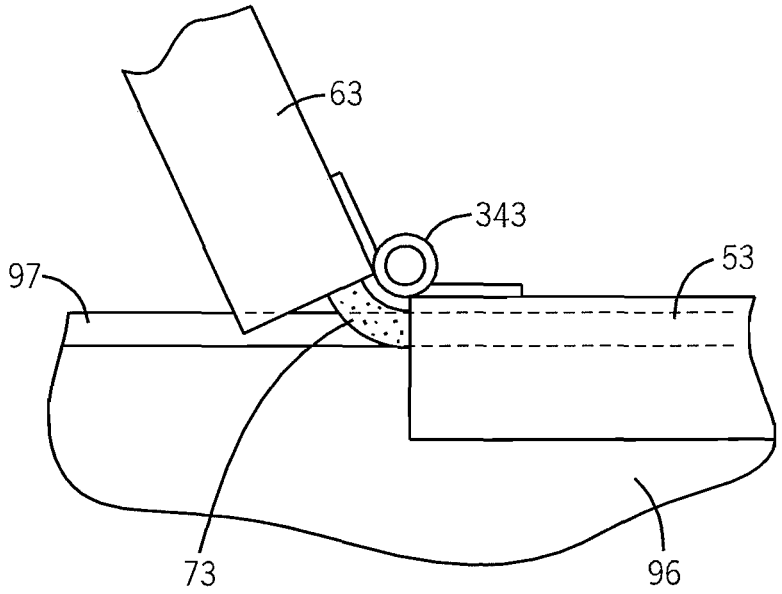
FIG. 8B is a further enlarged right side elevational view taken along line 8-8 of FIG. 7 and showing a second alternative embodiment of a hinge, a conventional one-piece hinge, used in the membrane cover.
Figure 9:
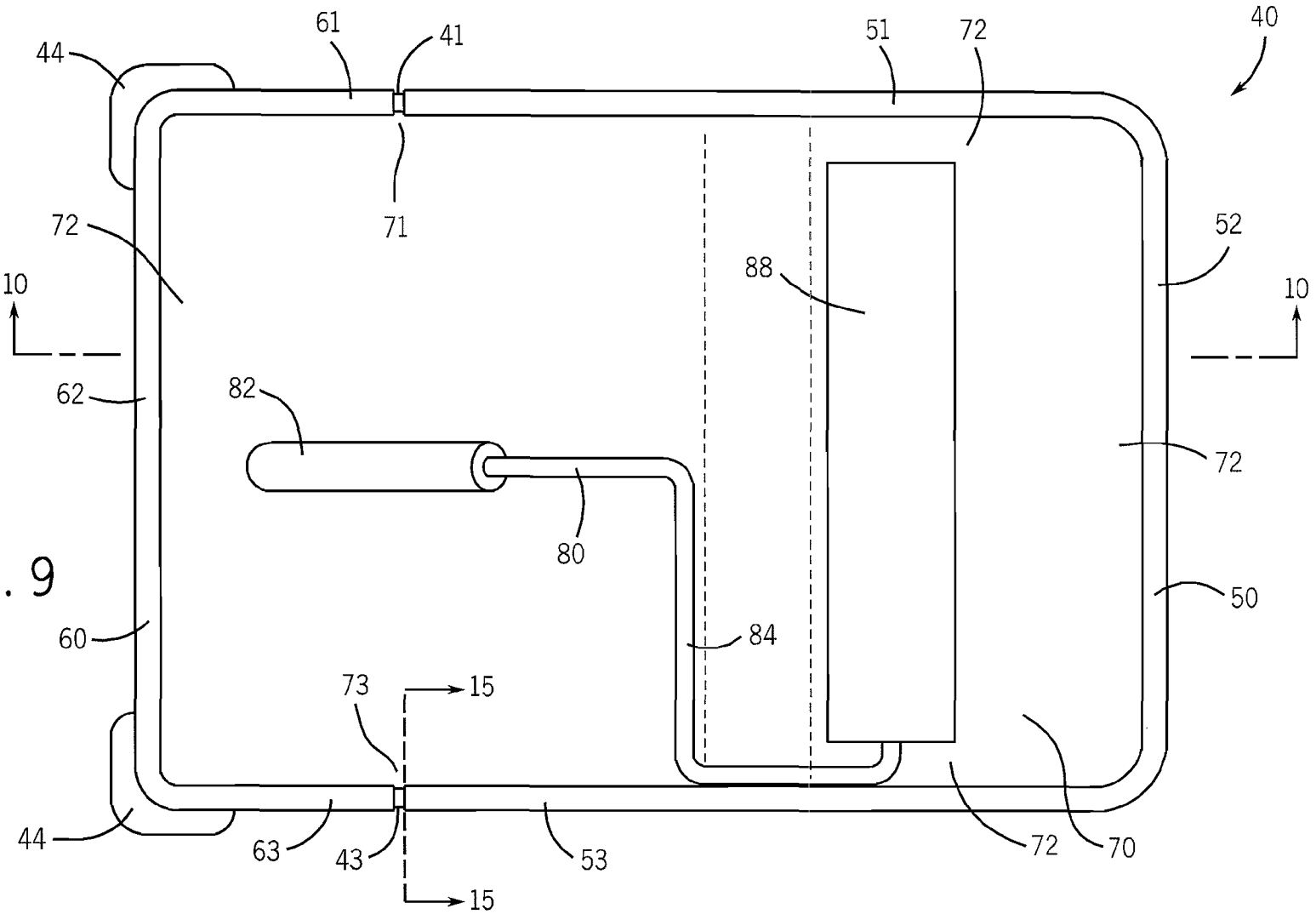
FIG. 9 is a top plan view of the membrane cover as attached to the conventional paint tray shown in FIGS. 1 and 2.

It should also be mentioned that, by lifting the second frame member 60 to a vertical or near vertical position (beyond what is shown in FIG. 8) results in the second frame member 60 being raised to a substantially perpendicular position relative to the first frame member 50. In this position (now shown), the second frame member 60 will remain in the full upright position due to the presence of the "anti-roll" structure 165 that is built into the second frame member 60. See FIG. 2B. What happens is that the anti-roll structures 165 effectively rest on and are supported by the upper margins 95, 97 of the tray 90 until the second frame member 60 is "snapped" down into place as is shown in FIG. 7.

The ability to lift the second frame member 60 of the membrane cover 40 is provided by means of the first break 41 between the first leg 51 of the first frame member 50 and the first leg 61 of the second frame member 60 and by means of the second break 43 between the third leg 53 of the first frame member 50 and the third leg 63 of the second frame member 60. Within the first break 41 is a hinge portion 71 of the peripheral edge 72 of the membrane 70. Similarly, within the second break 43 is another hinge portion 73 of the peripheral edge 72 of the membrane 70. See FIGS. 7 and 8. As previously disclosed, the first and second breaks 41, 43 could use a "live" hinge arrangement where a live hinge 243 is formed by a bridge of flexible material that would extend between the legs 51, 61, 53, 63 of the membrane cover frame portions 50, 60. See FIG. 8A. Alternatively, a conventional hinge 343 could be used as well. See FIG. 8B.

Figure 10:
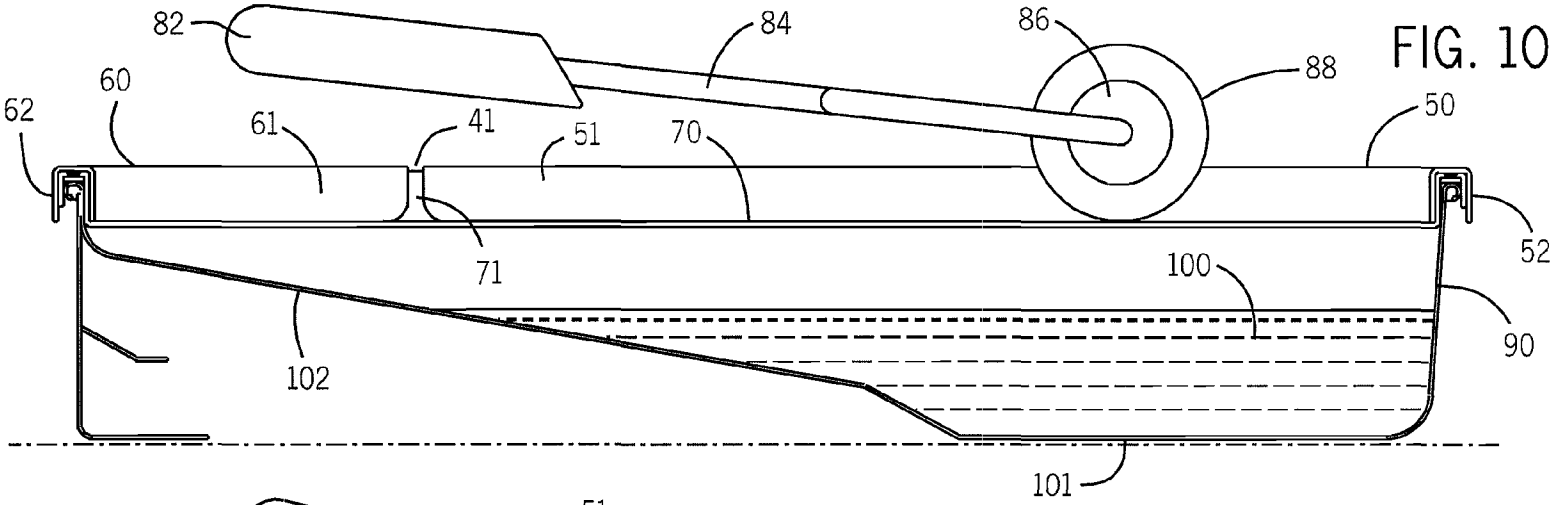
FIG. 10 is a right side elevational and partially sectioned view taken along line 10-10 of FIG. 9 and showing the paint roller positioned just above the membrane of the membrane cover.
Figure 11:
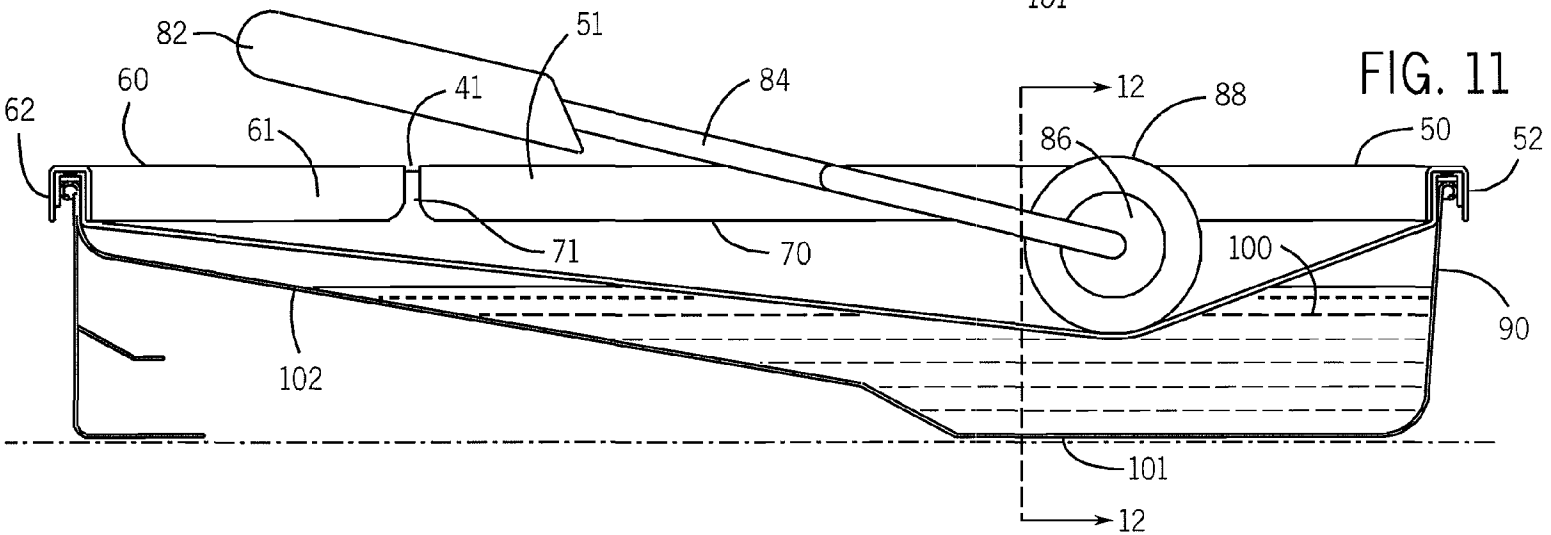
FIG. 11 is the same view as FIG. 10 and showing the paint roller lowered into and against the membrane to a level where paint below the membrane cover is displaced.
Figure 13:
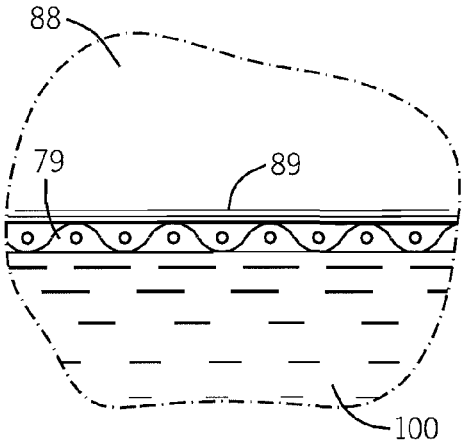
FIG. 13 is a further enlarged and sectioned view taken along line 13-13 of FIG. 12 and showing the membrane of the membrane cover at or near a center of the sleeve portion of the paint roller.

Once the paint tray 90 is loaded with paint 100, the user would then lower the second frame member 60, rotating it about the hinged portions 71, 73 of the membrane 70, and securing it to the margins 95, 97, 99 of the tray 90. The painter would then be ready to lower the absorbent sleeve 88 of the roller 80 such that it contacts the membrane 70 as shown in FIG. 10. The painter would continue to lower the absorbent sleeve 88 of the roller 80 to the point that the sleeve 88 would be at a level below that of the paint 100 that is contained within the tray 90. See FIGS. 12 and 13. This would allow some of the paint 100 to permeate and then penetrate the membrane 70 to transfer a layer of paint 100 onto the sleeve 88. The painter could move the sleeve 88 back and forth, and in a rolling fashion, along the membrane 70 to complete the loading of the sleeve 88 with paint 100. In this fashion, an amount of paint 100 is transferred onto the sleeve 88, but not evenly so.

Figure 16:
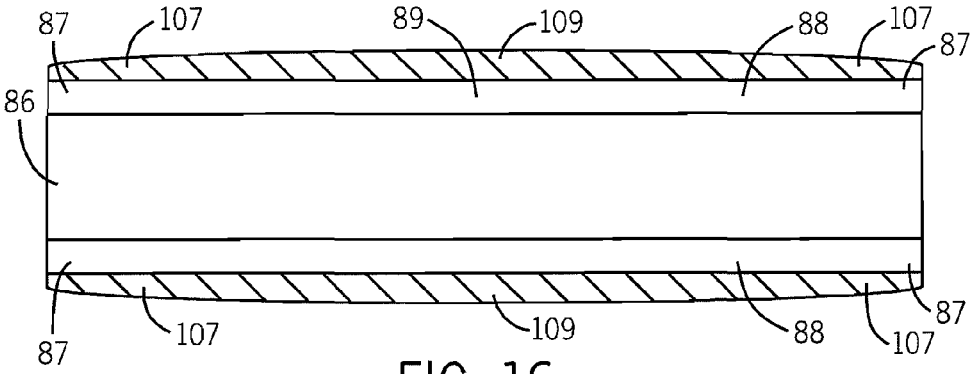
FIG. 16 is a top and sectioned view taken along line 16-16 of FIG. 12 and showing an exaggerated representation of the profile of paint that is "loaded" onto the sleeve portion of the paint roller after use of the assembly of present invention.

It should also be mentioned that, during this loading process, a number of other things are going on within the assembly 10. For example, during this process, the legs 51, 61, 53, 63 of the frame members 50, 60 are protecting the peripheral edges 72 of the membrane 70 from damage. During this process, the membrane 70 is resiliently stretched, but returns to its normal position due to memory within the membrane 70 and due to the fact that the membrane 70 is stretched across the opening 91 of the tray 90. Also during this process, a reserve of the resilient membrane 70 is protected and stored under its attachment area 72 on the legs 51, 61, 53, 63. This "reserve" allows the membrane 70 to pull down more easily toward the bottom of the tray 90 with the roller sleeve 88 or roller frame 84 in close proximity to the legs 51, 61, 53, 63 without excessive strain on the membrane 70 at its attachment area 72. See FIGS. 13 and 16 in particular.

Figure 14:
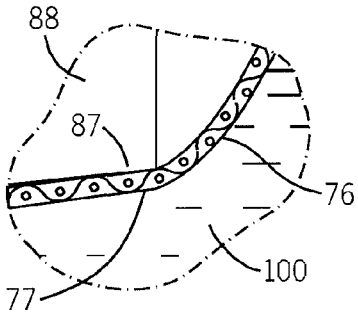
FIG. 14 is another enlarged and sectioned view taken along line 14-14 of FIG. 12 and showing the membrane being stretched at the edge of the sleeve portion of the paint roller.

As alluded to earlier, a key concept behind the assembly 10 of the present invention is that the membrane 70 loads the roller sleeve 88 heavier in the middle area 89 of the roller sleeve 88 and lighter at the edges or sides 87 due to the stretching of the membrane 70 and the forces it presents to the roller sleeve 88. The forces are greater on the edges 87 of the roller sleeve 88 thus helping to compress the absorbent portion of the sleeve 88 and restricting its capacity for paint absorption on those outside edges 87. The compressive forces and this functionality is illustrated by reference now to FIGS. 12 through 14. In the area towards the middle area 89 of the roller sleeve 88, the membrane 70 remains relatively unstretched. That is, as the compressive forces are reduced toward the middle area 89 of the roller sleeve 88, the pile of the roller sleeve 88 is allowed to absorb and hold more liquid. The membrane 70 thus loads the roller sleeve 88 in a profile that is shown generally, and in exaggerated form, in FIG. 16. That is, a slightly thicker loading of paint 109 occurs at the center 89 of the roller sleeve 88 and a slightly lighter loading of paint 107 occurs at the outer edges 87 of the roller sleeve 88. Thus, the roller sleeve 88 is loaded with paint 100 and is ready for application of the paint 100 to a wall (not shown). In this fashion, the device of the present invention transfers a smooth, even coat of paint with just one or two passes across the membrane 70, thereby substantially reducing painting time. In the experience of this inventor, less time is spent loading the roller sleeve 88 and no time is wasted working out the paint 100 on the wall.

Another important feature of the assembly 10 of the present invention is that the membrane 70 provides a very effective "tractive" force that allows the user to roll the roller sleeve 88 efficiently across the surface of the membrane 70 without the usual slipping and sticking as often occurs when a roller sleeve 88 passes over the ramped portion 102 of the conventional paint tray 90. See FIG. 2. This positive tractive force prevents such slipping and sticking, thus allowing more even roller sleeve loading without stoppages.

It is also to be noted that spilling of the paint 100 is avoided as any tipping of the tray 90 during use results in the membrane 70 serving as a barrier for the paint 100. That is, the paint 100 may push upwardly against the membrane 70, but will not spill through it.

Upon completion of a period of painting, the user may decide to stop his or her painting for a time. By snapping the cover 20 over the tray 90 with the roller 80 trapped within, as shown in FIG. 1, it is possible to greatly delay the drying of the paint 100 held within the tray 90. This makes it possible for the painter to set aside the paint roller 80, tray 90 and assembly 10 from as little as an hour or so, to a time of several weeks or more, all without the need to clean the roller 80.

According to the present invention, a paint tray 90 of typical manufacture, when used with an apparatus and assembly 10 as described herein, is not susceptible to spilling when filled with liquid paint 100. The apparatus also demonstrates a very significant improvement in applying paint to the working surface 88 of a roller 80. A uniform pressure against the roller surface 88 is all that is required to cover the working surface and impregnate it effectively. No rubbing or squeezing out action such as that required when removing excess paint 100 from a roller 80 with a conventional paint tray 90, is needed. The tendency of the paint 100 to distribute itself equally is a highly effective way of making a drip-free but high capacity exchange of paint between the tray 90 and the roller 80. As the paint supply 100 in the tray 90 diminishes, the membrane 70 may simply be pushed farther down and the roller 80 is effectively loaded in a similar, non-drip manner.

A paint tray 90 using the apparatus and assembly 10 of the present invention will hold up to about one gallon of paint, some four times as much as most common trays. This in and of itself is not disadvantageous because the membrane 70 that covers the paint 100 in the tray 90 resists slopping, splashing and spilling. When the roller sleeve 80 is passed over the membrane 70, the roller sleeve 80 becomes precisely loaded with just the right amount of paint 107, 109 for a smooth even application. This occurs when the roller sleeve 80 is passed evenly with one or two quick strokes across the membrane 70, rather than the constant back and forth motion required with paint rollers being rolled up against the contoured bottoms of conventional paint trays 90.

By having the roller 80 loaded as described above, it is not necessary to work out the paint 100 on the wall. Accordingly, the roller 80 may be stroked back and forth without having to perform the additional operation of applying paint and then spreading it while rolling the paint out. With this embodiment of the invention, the paint prematurely drying is avoided. Instead, the paint creates a more consistent job from start to finish. By running the paint 100 through the membrane 70, which acts as a filter, the painter can see and remove debris before it gets on the wall. This keeps the paint wet and makes cleanup fast and easy.

Figure 19:
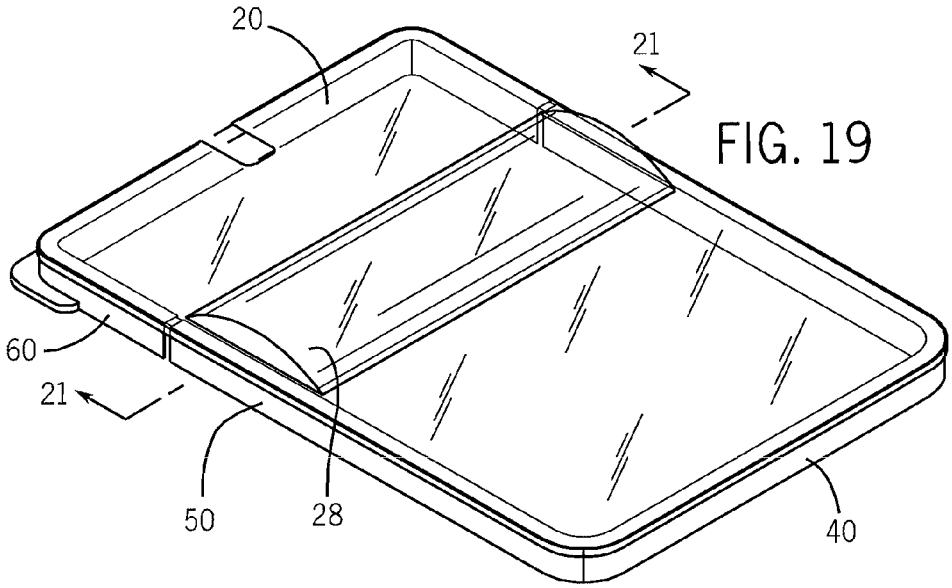
FIG. 19 is a view similar to FIG. 1 but showing only the impermeable plastic cover and the flexible membrane cover.
Figure 20:
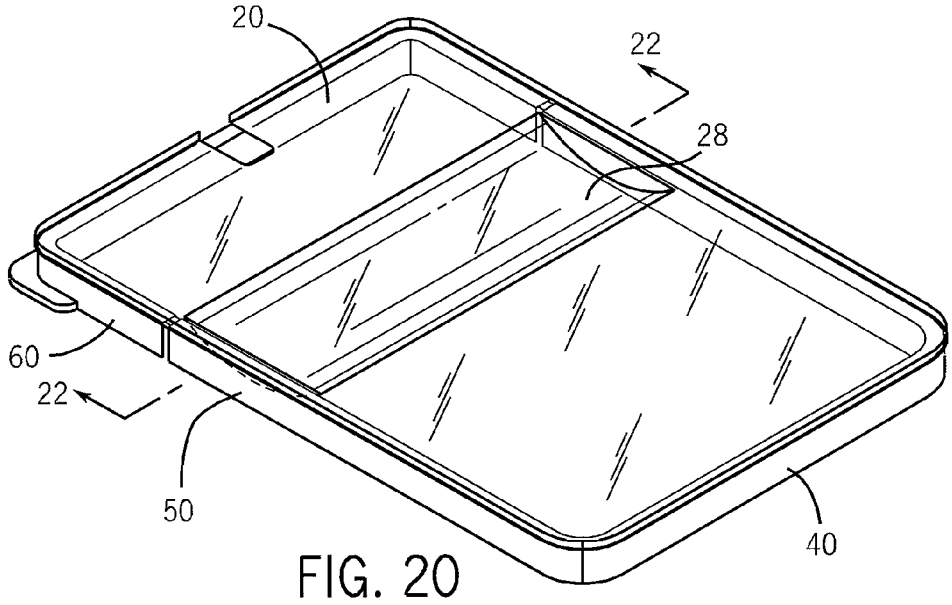
FIG. 20 is the same view as FIG. 19 but showing the plastic cover in an inverted position such that the dome of the plastic cover projects downwardly.
Figure 21:
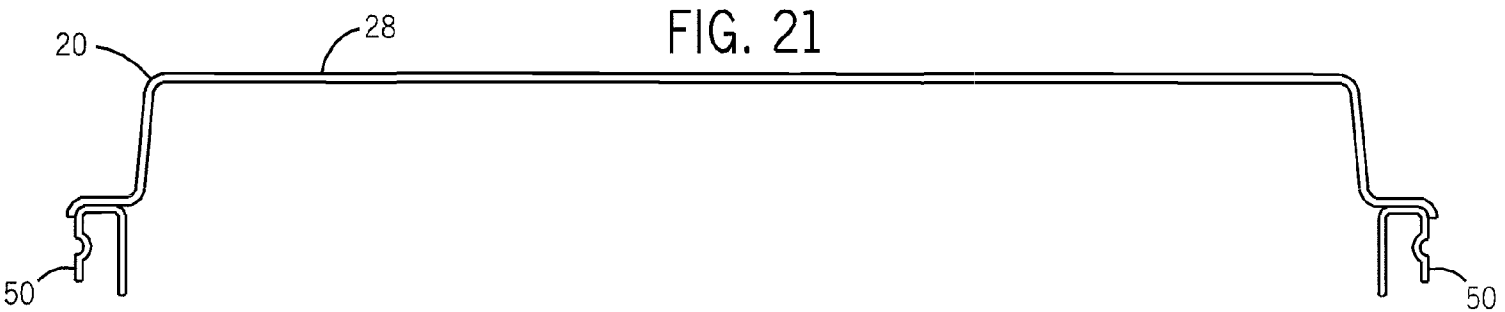
FIG. 21 is a sectioned view taken along line 21-21 of FIG. 19.
Figure 22:
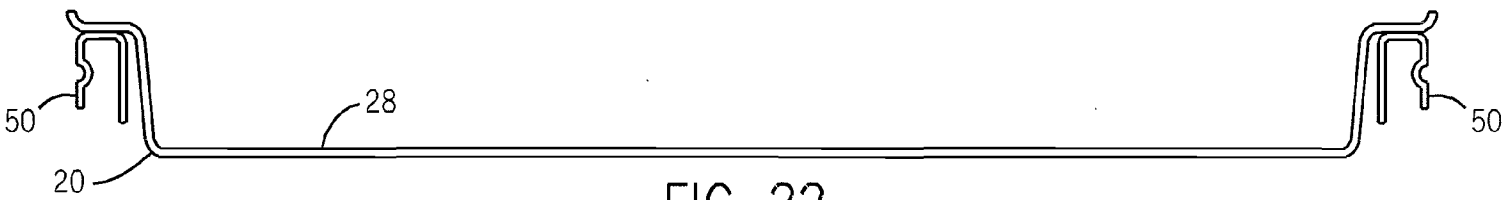
FIG. 22 is a sectioned view taken along line 22-22 of FIG. 20.
Figure 23:
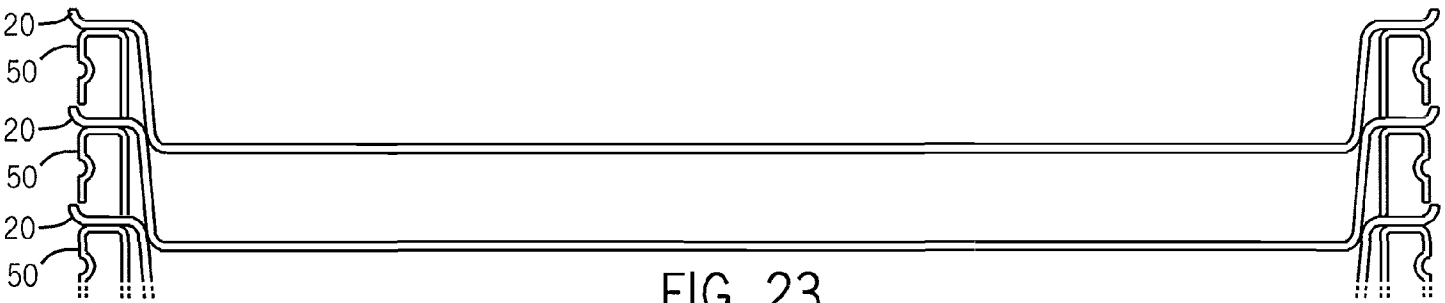
FIG. 23 is a sectioned view of a plurality of units of the type illustrated in FIGS. 20 and 22 and showing the units stacked in a bulk nesting configuration.

Other features that may be incorporated into the impermeable plastic cover 20 and the membrane cover 40 in the assembly 10 of the present invention included the ability to compact the covers 20, 40 for individual and bulk packaging, including the ability to nest them for bulk shipping. For example, FIGS. 19 and 20 illustrate two ways that the impermeable plastic cover 20 can overlay the membrane cover 40. In one position, shown in FIG. 19, the dome 28 projects upwardly. See FIG. 19. In FIG. 20, the cover 20 and its dome 28 are inverted and positioned such that the dome 28 projects downwardly. This configuration allows the assembly 10 to be packaged in a more compact format. See also FIGS. 21 and 22. The covers 20, 40 are also capable of being configured such that a plurality of adjacent covers 20, 40 can be "nested" for bulk packaging and shipment. See FIG. 23 in this regard. As shown in cross-section, it will be appreciated that the frame portions 50 of the membrane cover 40 fit under the lip of the plastic cover 20 to achieve this nesting effect. The exact form of nesting is not limited to that shown in FIG. 23, but can take other shapes and forms, such being within the scope of the present invention.

Figure 24:
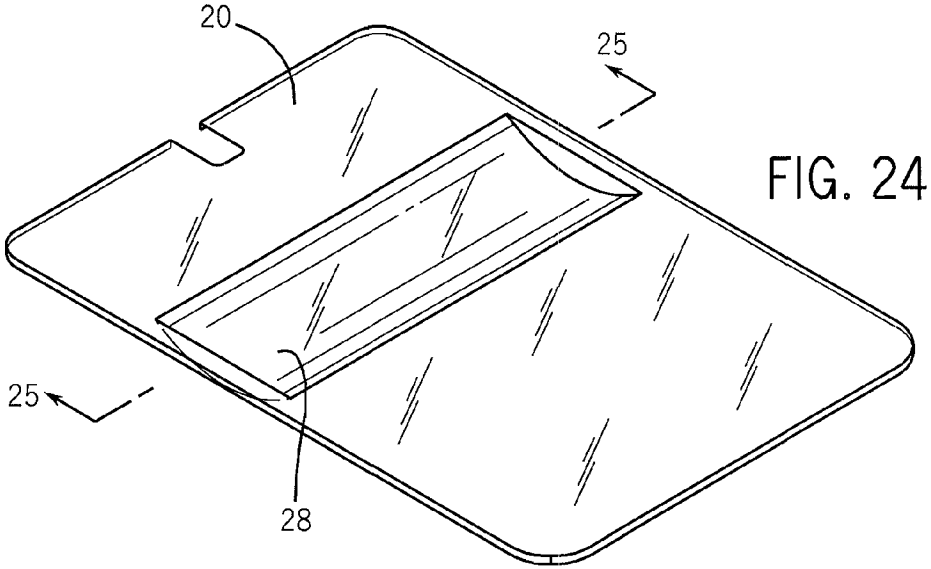
FIG. 24 is a view similar to FIG. 19 but showing the cover where the dome is a flexibly resilient "pop in" and "pop out" plastic cover structure, the dome being illustrated in a "pop in" position.
Figure 25:
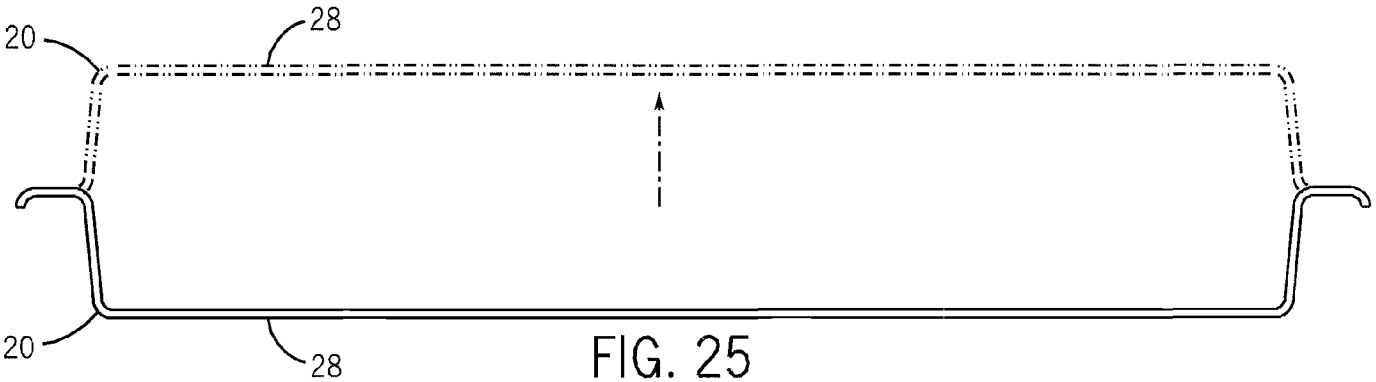
FIG. 25 is an enlarged cross sectioned view taken along line 25-25 of FIG. 24 and showing the "pop out" position of the dome in a phantom view.

An alternative to the embodiment whereby the plastic cover 20 is inverted, as is described above, would be to fabricate the cover 20 such that the dome 28 of the cover is formed as a flexibly resilient "pop in" and "pop out" plastic blister structure. See FIGS. 24 and 25. That is, the plastic blister dome 28 can effectively be "popped" inwardly (relative to the paint tray 100 onto which the cover 20 would be placed) during bulk stacking, storage, shipping, etc. as is shown in FIG. 24. The plastic blister dome 28 can then alternatively be "popped" outwardly to accommodate the placement of a roller 80 below the cover 20 during packaging, usage, etc. or whenever such is desired or required, as is shown in phantom view in FIG. 25.

Although the foregoing has been described with a certain degree of particularity, it is to be understood that the present disclosure has been made by way of example only and that numerous changes in the construction and the arrangement of components, some of which have been alluded to, may be resorted to without departing from the spirit and scope of the invention as it is described.

The principles of this invention being described in accordance with the foregoing, I claim as my invention the following:

1. A paint tray accessory that is capable of functioning with a paint tray, the paint tray comprising an access opening defined by a front wall portion, a back wall portion and a pair of opposing side wall portions, each wall portion comprising an upper margin, the upper margins being adjoined about the access opening, and the paint tray accessory being removably attached to the paint tray when used with the paint tray, the accessory comprising a subcombination, the subcombination comprising:

an impermeable plastic cover comprising a top portion and a flexible bottom flange surrounding and extending downwardly from the top portion to seal the access opening of the paint tray; and a membrane cover, the membrane cover comprising a first frame member comprising a substantially U-shaped frame member, a second frame member comprising a substantially U-shaped frame member, the first and second frame members being removably attached to the adjoining upper margins of the wall portions but separated at two break points along the opposing side wall portions of the paint tray and opposite one another relative to the access opening such that the second frame member can be separately detached from the wall portions and rotated upwardly about the break points, and a membrane, the membrane comprising a flexible and stretchable fluid regulating material that is secured to and suspended between the first and second frame members, the first and second frame members being complementary to one another to form a framework for the membrane that is suspended between them;

wherein the first frame member of the membrane cover comprises a first longitudinally-extending leg, a second longitudinally-extending leg and a third longitudinally-extending leg, the legs being integrally formed and the second leg being disposed between the other two legs of the first frame member, and wherein the second frame member of the membrane cover comprises a first longitudinally-extending leg, a second longitudinally-extending leg and a third longitudinally-extending leg, the legs being integrally formed and the second leg being disposed between the other two legs of the second frame member;

wherein the two break points comprise a first break and a second break, the first break being disposed between the first leg of the first frame member and the first leg of the second frame member, the second break being disposed between the third leg of the first frame member and the third leg of the second frame member, and wherein a portion of the membrane disposed within each break provides a hinged relationship between the frame members.

2. The subcombination of claim 1 wherein each of the legs of the first and second frame members of the membrane cover comprises an inverted and substantially U-shaped structure thereby creating a channel for receiving a peripheral edge of the membrane and a portion of an upper margin of a paint tray wall therein.

3. The subcombination of claim 2 further comprising means for fastening the peripheral edge of the membrane within the substantially U-shaped channels of the first and second frame members wherein a compliant seal is formed between the peripheral edge of the membrane and a portion of the upper margin of the wall of the paint tray to which the accessory is removably attached.

4. The subcombination of claim 3 wherein each of the first and third legs of the first and second frame member comprises a projection for stabilizing the legs at a point that is in close proximity to each of the first and second breaks.

5. The subcombination of claim 2 wherein each wall of the tray to which the accessory is removably attached comprises a portion facing the inside of the tray and a portion facing the outside of the tray and each leg comprises a first vertical structure disposed along the inside of the paint tray wall and a second vertical structure disposed along the outside of the paint tray wall.

6. The subcombination of claim 5 wherein the bottom of the first vertical structure is rounded to create a protective lip.

7. The subcombination of claim 6 wherein the first vertical structure of each of the first and third legs of the first and second frame members comprise a curved edge.

8. The subcombination of claim 5 wherein a reserve portion of the flexible and stretchable membrane material is formed behind the first vertical structure of the legs of the first and second frame members.

9. The subcombination of claim 8 wherein the membrane material provides a tractive force for the sleeve of a paint roller.

10. The subcombination of claim 9 wherein the membrane allows paint to be loaded heavier onto a middle area of the roller sleeve and lighter onto the edges of the roller sleeve.

11. The subcombination of claim 2 wherein the legs of the first and second frame members of the membrane cover can be configured to be attachable to variably sized paint trays.

12. The paint tray accessory subcombination of claim 2 wherein the first and second frame members are attachable to similarly sized paint trays.

13. The subcombination of claim 2 wherein a living hinge is formed between the first and second frame members at each of the breaks.

14. The subcombination of claim 2 wherein a conventional hinge is attached to the first and second frame members at each of the breaks.

15. A paint tray assembly comprising:

a paint tray, the paint tray comprising an access opening defined by a front wall portion, a back wall portion and a pair of opposing side wall portions, each wall portion comprising an upper margin, the upper margins being adjoining about the access opening;

an impermeable plastic cover comprising a top portion and a flexible bottom flange surrounding and extending downwardly from the top portion to seal the access opening of the paint tray; and a membrane cover, the membrane cover comprising a first frame member comprising a substantially U-shaped frame member, a second frame member comprising a substantially U-shaped frame member, the first and second frame members being removably attached to the adjoining upper margins of the wall portions but separated at two break points, one break point disposed along each of the opposing side wall portions of the paint tray and opposite one another relative to the access opening such that the second frame member can be separately detached from the upper margins of the wall portions and rotated upwardly about the opposing break points, and a membrane, the membrane comprising a flexible and stretchable fluid regulating material that is secured to and suspended between the first and second frame members, the first and second frame members being complementary to one another to form a framework for the membrane that is suspended between them;

wherein the first frame member of the membrane cover comprises a first longitudinally-extending leg, a second longitudinally-extending leg and a third longitudinally-extending leg, the legs being integrally formed and the second leg being disposed between the other two legs, and wherein the second frame member of the membrane cover comprises a first longitudinally-extending leg, a second longitudinally-extending leg and a third longitudinally-extending leg, the legs being integrally formed and the second leg being disposed between the other two legs; and wherein the two break points comprise a first break and a second break, the first break disposed between the first leg of the first frame member and the first leg of the second frame member, the second break being disposed between the third leg of the first frame member and the third leg of the second frame member, and wherein a portion of the membrane disposed within each break provides a hinged relationship between the frame members.

16. The paint tray assembly of claim 15 wherein each of the legs of the first and second frame members of the membrane cover further comprises in cross section an inverted U-shape thereby creating a channel for receiving a peripheral edge of the membrane and a portion of an upper margin of a paint tray wall therein.

17. The paint tray assembly of claim 16 further comprising means for fastening the peripheral edge of the membrane within the substantially U-shaped channels of the first and second frame members wherein a compliant seal is formed between the peripheral edge of the membrane and a portion of the upper margin of the wall of the paint tray.

18. The paint tray assembly of claim 17 wherein each of the first and third legs of the first and second frame member comprises a projection for stabilizing the legs at a point that is in close proximity to each of the first and second breaks.

19. The paint tray assembly of claim 16 wherein each wall of the tray comprises a portion facing inside of the tray and a portion facing the outside of the tray and each leg comprises a first vertical structure disposed along the inside of the paint tray wall and a second vertical structure disposed along the outside of the paint tray wall.

20. The paint tray assembly of claim 19 wherein the bottom of the first vertical structure is rounded to create a protective lip.

21. The paint tray assembly of claim 20 wherein the first vertical structure of each of the first and third legs of the first and second frame members comprise a curved edge.

22. The paint tray assembly of claim 19 wherein a reserve portion of the flexible and stretchable membrane material is formed behind the first vertical structure of the legs of the first and second frame members.

23. The paint tray assembly of claim 21 wherein the membrane material provides a tractive force for the sleeve of a paint roller.

24. The paint tray assembly of claim 23 wherein the membrane allows paint to be loaded heavier onto a middle area of the roller sleeve and lighter onto the edges of the roller sleeve.

25. The paint tray assembly of claim 16 wherein the legs of the first and second frame members of the membrane cover can be configured to be attachable to variably sized paint trays.

26. The paint tray assembly of claim 16 wherein the first and second frame members are attachable to similarly sized paint trays.

27. The paint tray assembly of claim 16 wherein a living hinge is formed between the first and second frame members at each of the breaks.

28. The paint tray assembly of claim 16 wherein a conventional hinge is attached to the first and second frame members at each of the breaks.

* * * * *